United States Patent [19]

Sanders

[11] Patent Number: 5,074,140

[45] Date of Patent: Dec. 24, 1991

[54] METHOD AND METHOD FOR HIGH SPEED CABLE SHAPING AND STRANDING

[75] Inventor: Eugene T. Sanders, Carrollton, Ga.

[73] Assignee: Southwire Company, Carrollton, Ga.

[21] Appl. No.: 587,889

[22] Filed: Sep. 25, 1990

[51] Int. Cl.[5] ..... B21F 7/00

[52] U.S. Cl. ..... 72/248; 57/9

[58] Field of Search ..... 57/9, 215; 72/206, 248

[56] References Cited

U.S. PATENT DOCUMENTS

| | | | |
|---|---|---|---|
| 1,888,807 | 11/1932 | Rivers | 72/248 |
| 2,156,652 | 5/1939 | Harris | 57/9 |
| 4,173,235 | 11/1979 | Tipper | 140/82 |
| 4,212,151 | 7/1980 | Schauffelle et al. | 57/9 |
| 4,843,696 | 7/1989 | Gentry et al. . | |

FOREIGN PATENT DOCUMENTS

| | | |
|---|---|---|
| 25167 | 11/1935 | Australia . |
| 595245 | 1/1926 | Fed. Rep. of Germany . |

*Primary Examiner*—Lowell A. Larson

*Attorney, Agent, or Firm*—James W. Wallis, Jr.; George C. Myers, Jr.

[57] ABSTRACT

A method and an apparatus for the high speed shaping of wires to be used to make a compact stranded cable are disclosed. A plurality of roll pairs for shaping the cross section of a wire in a peripheral groove are mounted to the layhead of a strander apparatus. The rolls of each pair are supported on axles, the axes of which are maintained parallel to each other. At least one of the rolls of each pair is mounted on an axle which is parallelly adjustable toward and away from the other axle. A single adjustment screw is provided for urging the adjustable axle in a direction to engage the peripheries of the rolls.

20 Claims, 3 Drawing Sheets

METHOD AND METHOD FOR HIGH SPEED CABLE SHAPING AND STRANDING

FIELD OF THE INVENTION

The invention relates to high speed manufacture of compact stranded cable, particularly electrical cable. More particularly, the present invention is directed to a method of and apparatus for both forming a shaped wire and stranding the wire to form a compact stranded cable in a single operation.

DESCRIPTION OF THE PRIOR ART

Electrical conductors are customarily fabricated by stranding together a plurality of wires in concentric layers, as is described in U.S. Pat. No. 4,843,696, assigned to the assignee of the present invention. The resulting interstitial spacing may be reduced by compaction of the stranded cable, as is taught in U.S. Pat. No. 1,943,082. The advantages and disadvantages of such practice are described in the aforementioned U.S. Pat. No. 4,843,696. Further improvements in the art are illustrated in U.S. Pat. No. 4,843,696, which teaches the preshaping of the ordinarily round wire as it exits a conventional drawing machine, the disclosure of which is incorporated herein by reference.

An improvement in the method and apparatus of U.S. Pat. No. 4,843,696 is illustrated in my earlier U.S. Pat. application No. 07/342,052, also assigned to the assignee of the present invention, and the disclosure of which is incorporated herein by reference. In that application, certain fin and/or flash defects, which occurred when the input wire was of uneven cross section, were eliminated. That application also teaches that the individual wires should be drawn, preshaped, collected on spools, reels, or the like, and then later stranded together to form the compact cable feedstock The production speed of the shaped wire made according to the application is limited to the speed of the drawing machine from which the round wire exits upon completion of the drawing process. The process of stranding wire can be much faster than the process of drawing wire because the wire is simply being advanced along a predetermined stranding path, while during drawing the wire feedstock is subjected to substantial metallurgical deformation, thus limiting the drawing of the wire to a lower speed. Additionally, multiple drawing machines are required to produce the many preshaped wires forming a stranded cable, thus limiting productivity.

German Patent No. 595,245 teaches the use of a plurality of wire cross section forming and shaping assemblies mounted to layhead, each forming and shaping assembly being arranged at an angle to the radius of the layhead. Each assembly comprises two pair of rolls, each pair being orthogonally mounted with respect to the other pair.

One limitation of my earlier U.S. Pat. No. 4,843,696 and U.S. application No. 07/342,052, is that the required parallelness of the respective roll axes is not always easy to achieve and maintain Two adjustment screws are required for each axle; thus, two adjustment screws must be carefully set relative to one another and locked for each roll axle to be properly positioned, and four adjustment screws must be carefully set relative to one another and locked for each pair of forming and shaping rolls.

Adjustment of the forming and shaping assembly axles (and thus the rolls) as taught by the German patent is substantially more complex. The number of rolls used is doubled, therefore, the number of axles is also doubled. Thus, the number of screw adjustments required is also doubled so that eight adjustment screws must be carefully set and locked relative one another with substantial precision in order to maintain the four axles of each forming and shaping assembly in the correct position, and each pair of forming and shaping rolls must be adjusted to a substantially perfect right angle to the other pair of rolls in the forming and shaping assembly. Typically, as many as nine or ten forming and shaping assemblies may be required for a given cable. Maintaining the required precision would be nearly impossible in the heavy equipment industrial setting of a cable stranding machine.

While my U.S. Pat. No. 4,843,696 and U.S. application No. 07/342,052 substantially reduce the complexity of the apparatus illustrated by the German patent in that the number of pairs of forming and shaping rolls cooperating to form and shape a given wire is reduced to one, some degree of complexity remains as at least one of the axles requires two adjustments and the adjustments for a given forming and shaping assembly must be substantially perfect for practical operation.

SUMMARY OF THE INVENTION

The present invention comprehends modification of the stranding apparatus and stranding method to form the preshaped wire as the wire is advanced through the strander. A plurality of wire guide and shaping assemblies, each including a pair of forming and shaping wheels and each wheel being mounted on parallel axles in a frame, form the wire. One of the axles is held by a yoke slidably seated in a channel in the frame such that the spacing between the axles may be adjusted without varying the parallel alignment of the axles or the wheel alignment. A single screw adjustment moves the yoke back and forth in its channel. Adjustment of the axle spacing separating each forming and shaping wheel is thus reduced to only one adjustment screw for each pair of shaping wheels, greatly reducing setup and operating maintenance.

It is an object of the present invention to minimize difficulty in adjustment of the forming and shaping wheel axes into parallel alignment, and in maintaining such alignment.

Another object of the present invention is to provide a method and apparatus to form and shape round drawn wire to a desired cross section without formation of fin and/or flash thereon.

A further object of the present invention is to provide a method of both forming the preshaped wire and of stranding the preshaped wire into the compact cable in a single operation.

Yet another object of the invention is the provision of apparatus for simultaneously forming and shaping a plurality of round drawn wires into a compact cable with a desired cross section, in which each wire is formed and shaped at a substantially greater speed than typical of the drawing process, and thereby substantially improving the production speed of the compact cable.

It is another object of the present invention to provide a combination of a plurality of easily adjusted forming and shaping assemblies with a strander to permit both shaping of a drawn wire and stranding of the shaped wire into a compact cable in a single apparatus.

A feature of the present invention is the provision of an axle-engaging yoke slidably retained in a pair of parallel grooves to simplify adjustment of the wheel axle spacing and to maintain the axles in parallel alignment.

Another feature of the present invention is that the forming and shaping of the plurality of drawn wires occurs after any intervening metallurgical process steps following drawing of the wire.

Yet another feature of the present invention is a substantial increase in production rate of compact stranded cable, made possible by combining the shaping and stranding steps of multiple wires in a single operation at high stranding speeds.

Still another feature of the present invention is the provision of method and apparatus for forming each of the different shapes required for the various compact cable individual wire components.

Another feature of the present invention is the provision of apparatus for forming and shaping the plurality of strander input wires into shaped compact cable wires during the stranding operation.

An advantage of the present invention is that the forming and shaping wheel axles are easily set into parallel alignment and remain so even when adjustment of the spacing between the axes is necessary.

Yet another advantage of the invention is that the wheel axis spacing is adjustable with a single adjustment screw for each roll axle.

Another advantage of the present invention is that by forming and shaping the wires immediately prior to stranding, wire surface defects are reduced which results in fewer interstitial defects within the compact stranded cable.

Yet another advantage of the present invention is reduced fin or flash formation in the formed and shaped wire.

Still another advantage of the present invention derives from the fact that metallurgical and/or heat treatments of the drawn wire may be performed after drawing and prior to the stranding operation.

Another advantage of the present invention resides in the combination of method and apparatus for forming and shaping multiple strander feed wires in a single operation at the stranding speed, resulting in substantially greater production rates of compact stranded cable.

In accordance with these and other features and advantages of the present invention hereinafter disclosed, there is provided a method of and an apparatus for the combination of high speed forming and shaping of drawn wire and the stranding of the same in a single operation and apparatus.

The method of accomplishing the foregoing includes the steps of providing a layhead with a plurality of wire guide and shaping assemblies mounted thereon, adjusting the spacing of each of the respective axes of the forming wheel pairs used to form and shape the wire cross sections, for all of the wire guide and shaping assemblies used to form the cable. The cable is then formed by advancing a plurality of wires through the strander; guiding the plurality of wires through the layhead in the strander; forming each of the plurality of wires into a predetermined non-circular shape at or near the layhead plane, each of the wires being formed in a plurality of individual high speed wire guide and shaping assemblies for changing the cross section of the wire; each wire guide and shaping assembly including a first profiled wire shaping wheel rotatable about a first axis and a second wire shaping wheel rotatable about a second axis wherein the second axis is substantially parallel to the first axis and the wheels are aligned with respect to one another; stranding the shaped wires into cable; and collecting the stranded cable.

An additional step of subjecting the stranded cable to a further compacting step or cross section altering step may be performed Other processing may include a step wherein the wire shaping wheels cooperate to form a desired wire passage having a predetermined cross section, such as a trapezoidal cross section, a sector cross section including at least one curvilinear surface, and/or a sector cross section including at least one flat surface, in order to provide the specific profiles necessary to form the desired cable cross section.

The apparatus for accomplishing the foregoing features and advantages comprises an apparatus for forming and shaping a plurality of wires into a stranded cable; a device for advancing a plurality of wires into the forming device; a layhead for guiding the plurality of wires into the forming device; and a plurality of wire guide and shaping assemblies mounted thereon for shaping the plurality of wires. Each of the wire guide and shaping assemblies includes a frame, a first wire shaping wheel rotatable about a first axis and a second wire shaping wheel rotatable about a second axis, the second axis being substantially parallel to and adjustably displaced from the first axis; a slidable yoke supporting one of the wheels and slidable in channels in the frame for adjusting the displacement of the first and second wheel axes while maintaining the axes parallel. The assembly frame is adapted for mounting the assembly wheels to the layhead. The yoke is provided for both maintaining the wheel axes parallel and for adjusting the displacement of the first and second wheels.

Additional features and apparatus may include those wherein the wire shaping wheels cooperate to form a wire passage of a desired, predetermined cross section such as a trapezoidal cross section, a sector cross section including at least one curvilinear surface, and/or a sector cross section including at least one flat surface, in order to provide the conductor cross sections necessary to form the desired cable cross section. In another feature of the apparatus, at least one of the wire shaping wheels further includes opposing flanges which substantially enclose the wire for restricting the wire passage to the desired predetermined cross section. The adjustment device for adjusting the displacement of the first and second axes is preferably in the form of a slidable yoke supporting one of the wheel axles, in combination with an adjustment screw which is threaded into the threaded bore of a plate disposed in opposed parallel channels in the frame and which bears on the yoke. The other wheel axle is fixed in position to prevent movement. Rotation of the adjustment screw in the plate varies the displacement between the wheel axles.

With the foregoing and other advantages and features of the invention that will become hereinafter apparent, the nature of the invention may be more clearly understood by reference to the following detailed description of the invention, the appended claims, and to the several views illustrated in the attached drawings.

DETAILED DESCRIPTION OF THE INVENTION

Figure 1:
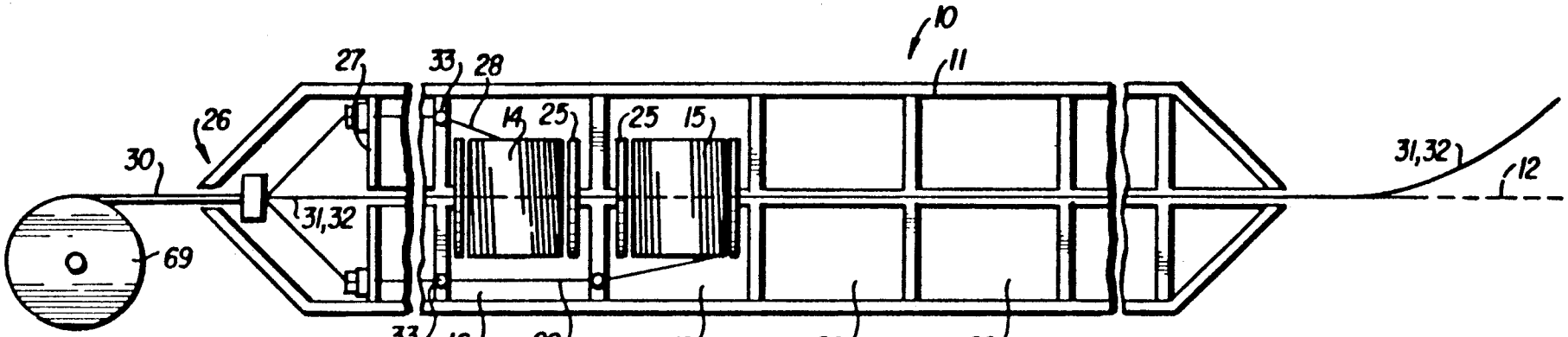
FIG. 1 is a simplified diagram of a stranding apparatus including the present invention.

Referring now in detail to the drawings wherein like parts are designated by like reference numerals throughout, there is illustrated schematically in FIG. 1 a wire stranding machine designated generally by the reference numeral 10. The stranding machine 10 is a conventional strander or the equivalent which comprises a housing 11 rotatable about an axis 12, a plurality of sources of wire 14, 15 (only two shown), each of which is contained within a wire storage area 16, 18, 20, 22 within stranding machine 10, and each of which may be a spool 25 of wire. At the forward or downstream end 26 of the stranding machine 10, a layhead 27 (also known as a layplate) may be required to guide the individual wires 28, 29, etc. into their desired positions to form a cable 30. The individual wires 28, 29, etc., may be placed around one or more central wires 31, 32. Wires 31, 32 may be shaped as needed or formed of two or more preshaped wires. The central wire or wires may also be omitted, in which case only the concentric layers of cable are laid up to form the desired cable configuration.

Figure 2:
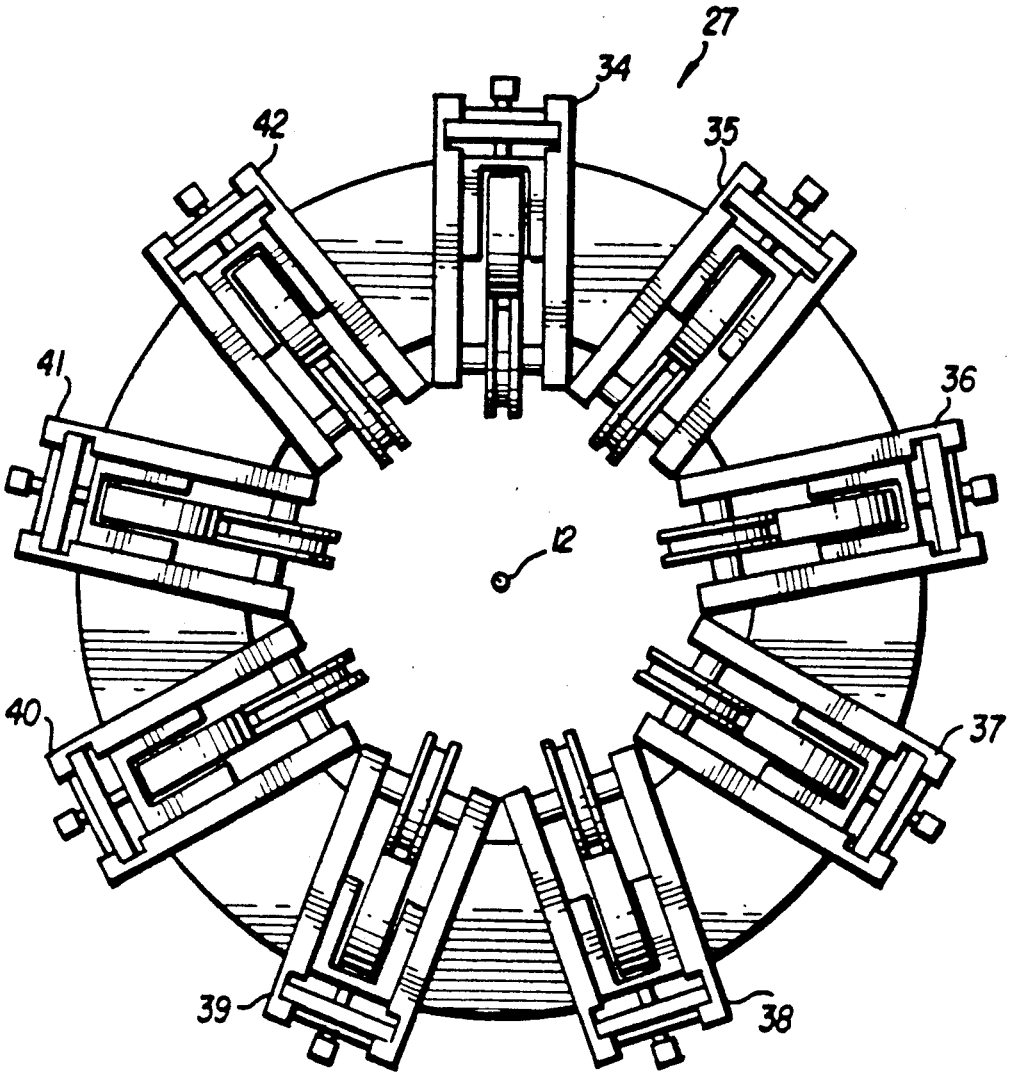
FIG. 2 is an end elevation view of a strander 9-wire layhead as adapted for the present invention.

In stranders of the kind illustrated, as each individual wire is payed off from a respective spool 25, it is guided to the rotating layhead 27, where the individual wires 28, 29, etc., are guided to form the stranded cable 30. It is conventional to guide the payed out wires with one or more pulleys or guide tubes 33 in directing the individual wires to the layhead. The spools 25 may rotate as the wire is removed therefrom, or the spools may be fixed and the wire slipped off therefrom, as in the case of stranders of the known tapered flange type. In the tubular strander 10 shown, the individual wires are first wound on spools, then installed into the strander so as to rotate and unwind as the wire is payed out to the layhead. Layhead 27 as used in the present invention is modified as shown in FIG. 2 by adding a plurality of wire guide and shaping assemblies 34–42, one of which is shown in more detail in FIG. 3.

Wire guide and shaping assemblies 35–42 are substantially identical to wire guide and shaping assembly 34, which will be discussed in greater detail hereinafter. The layhead 27 illustrated in FIG. 2 is a nine-wire layhead adapted to include nine wire guide and shaping assemblies 34–42, one for each of the nine wires. Each of these wire guide and shaping assemblies is used to form and shape an individual wire into the desired cross section. Many conventional stranders and many cable configurations do not require a layhead. In such circumstances, a layhead 27 or similar support must be added to strander 10 to practice the present invention.

Figure 5:
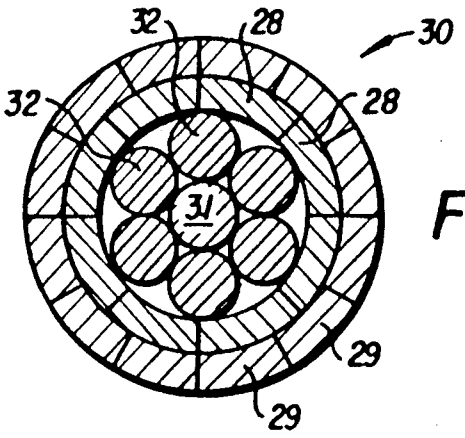
FIG. 5 is a transverse section of a cable illustrating one example of shaped wires formed into a stranded cable.

A cable 30 having a typical cross section is shown in FIG. 5. Core wire 31 is surrounded by several strands of wire 32, core wire 31 and strands 32 being of substantially the same diameter. Surrounding these wires are formed wires 28 and 29, which are shaped so that they have substantially less interstitial space than an equivalent concentric lay conductor with a round cross section.

The wire guide and shaping assemblies 34–42 are mounted on the layhead 27 about the longitudinal axis 12 of the strander and are intended to provide the smoothest possible transition of the wires 28, 29 from their initial shape to the desired postforming cross section, typically a trapezoid One or more of the wire cross sections may differ, as required by the desired cable cross section. See wires 28 and 29 of FIG. 5.

Figure 4:
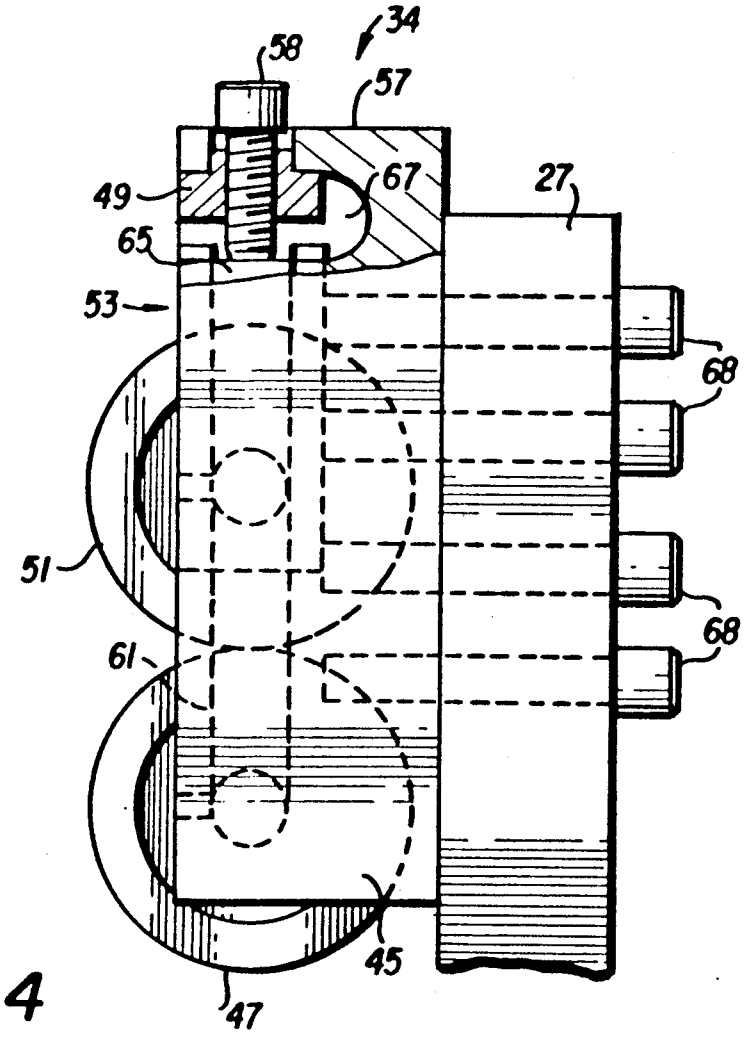
FIG. 4 is a side elevation view, partly in section, of the wire guide and shaping assembly of FIG. 3.
Figure 3:
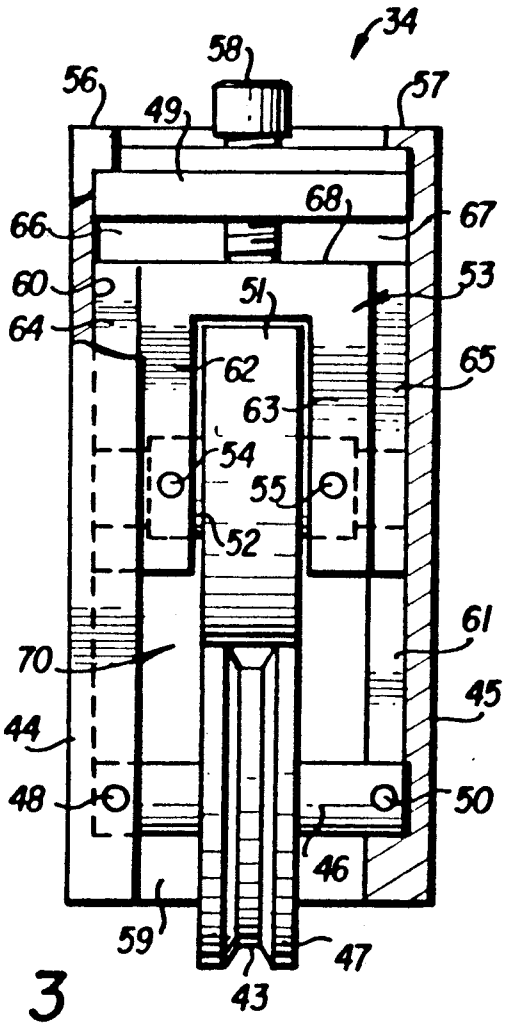
FIG. 3 is an end elevation view, partly in section, of a wire guide and shaping assembly of the invention used for each of the plurality of wires, as viewed from the wire exit.

The wire guide and shaping assembly 34 shown in FIGS. 3 and 4 includes a pair of parallel side plates 44, 45, each of which has a longitudinal channel or guideway 60, 61 on the inner surface thereof. A first axle shaft 46 is supported at its ends at the lowermost extremity of the guideways 60, 61 and is fixedly mounted between the side plates 44, 45 by suitable fasteners 48, 50. A first forming and shaping wheel 47 is rotatably supported on shaft 46. A suitable bearing assembly (not shown) is preferably disposed between the shaft 46 and the wheel 47 to reduce rotating friction and increase load capacity. Alternatively, the wheel could be fixed to the shaft 46 and the shaft journalled in the side plates 44, 45, with or without bearings. First wheel 47 is provided with a peripheral groove 43 which is trapezoidal in shape in the embodiment shown. Other shapes as described above may be used. My aforementioned application Ser. No. 07/342,052, the disclosure of which is incorporated herein by reference, illustrates other wheel shapes, profiles and configurations useful in practicing the present invention.

A second forming and shaping wheel 51, rotatable on second axle shaft 52 (which is parallel to and spaced apart from first axle shaft 46), is adapted to be positioned with its periphery in contact with the periphery of first wheel 47 so as to close the trapezoidal groove 43 in the periphery of first wheel 47. A suitable bearing assembly (not shown) is preferably disposed between the shaft 52 and the wheel 51 to reduce rotating friction and increase load bearing capacity. A bifurcated yoke 53 supports the second axle shaft 52 which is fastened to the yoke by suitable fasteners 54, 55. Yoke 53 comprises a pair of legs 62, 63, each having an embossment or projection 64, 65 on the outer side thereof which engages and is guided for longitudinal (up-and-down) movement in a respective channel 60, 61.

The longitudinal channels 60, 61 have a radius at the lower ends thereof which corresponds with the radius of the first axle shaft 46 and extend upwardly through the upper ends 56, 57 of the side plates 44, 45. The bifurcated yoke 53 can therefore be inserted between the side plates 44, 45 by engaging the lowermost ends of the side projections 64, 65 in the upper, open ends of the channels 60, 61 and sliding the yoke downwardly until the periphery of second wheel 51 engages the periphery of first wheel 47. The side projections 64, 65 each have a height and transverse dimension which corresponds closely to the depth and transverse dimension respectively of the channel 60, 61 in which each respective projection is guided. Similarly, the side plates 44, 45 are positioned relative to one another on the layhead 27 to limit the side-to-side play between the yoke 53 and the side plates and provide a snug fit between the projections 64, 65 and the channels 60, 61. Such positioning and dimensioning will insure that the axis of shaft 52 will be maintained substantially parallel to the axis of shaft 46.

On the inner surfaces of the side plates 44, 45 adjacent the upper ends 56, 57 thereof there are provided transverse slots or notches 66, 67 which intersect with the channels 60, 61 and which, like the channels 60, 61 have a radius at one end and are open at the other end (FIG. 4). A pressure plate 49 having a generally T-shaped cross-section is slidable into the open ends of the slots 66, 67 and is engagable in the upper ends of the channels 60, 61 as best shown in FIG. 4.

A single adjustment screw 58 is threaded into a central threaded bore in pressure plate 49 so as to bear upon the upper end face 68 of the yoke 53. After the yoke 53 has been inserted into the confronting channels 60, 61, the pressure plate 49 is inserted into the confronting slots 66, 67 and engaged in the channels 60, 61. The adjustment screw 58 is threaded into the pressure plate 49 so that its free end bears upon the end face 68 of the yoke 53. As will be appreciated, adjustment of screw 58 downwardly as viewed in FIGS. 3 and 4 forces the periphery of second wheel 51 into tight engagement with the periphery of first wheel 47.

A frame or back plate 59 (FIG. 3) may be provided to join the plates 44, 45 together at the appropriate spacing. Alternatively, the plates may be fastened directly to layhead 27 by suitable fasteners 68 as shown in FIG. 4. It is important that the axles 46, 52 be maintained parallel and that the wheels 51, 47 be maintained in precise alignment. Precise alignment of the parts is desired to ensure that the wire is completely contained in the closed groove 43 as it passes therethrough and is formed into the desired cross section without the formation of undesirable fins or flashing at the peripheral interface or nip 73 between the wheels 47, 51.

In operation, the strander (FIG. 1) is conventionally strung up with a plurality of wires on a number of spools equal to the number of wires forming the cable. The wires are directed in the conventional manner to the layhead. Layhead 27 is adapted to support a plurality of wire guide and shaping assemblies 34–42, one for each wire of the cable. Each of the wires is passed through a respective wire guide and shaping assembly and onto the start of the cable. The strander is caused to rotate and the cable is withdrawn to a take-up reel 69. As the strander is rotated and the take-up reel is advanced, the individual wires are advanced through the forming and shaping wheels where they are formed and shaped to the predetermined cross section. The shaped wires are then immediately twisted to form the cable 30, which is withdrawn and wound around the take-up reel 69. Adjustment of the wire guide and shaping assembly axles 46, 52 is essential to the proper shaping of the spool wires into the desired cross section.

One or more additional processing steps, which are not necessary to the subject of the present invention, may be performed to produce the finished cable. Such steps include compacting the stranded cable to close and reduce interstitial gaps between the strands, insulating the finished cable, and the like.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for stranding a cable from wires comprising a layhead, a plurality of means mounted on said layhead for shaping said wires prior to stranding, at least some of said wires being arranged to pass through a respective wire shaping means, each wire shaping means comprising a first wire shaping wheel rotatable about a first axis, a second wire shaping wheel rotatable about a second axis, means for adjusting the spacing between said first and second axes and means for maintaining said first and second axes substantially parallel to one another, said adjusting means comprising only one adjustment member.

2. Apparatus according to claim 1, wherein said only one adjustment member is only one adjustment screw.

3. Apparatus according to claim 1, wherein said means for maintaining said first and second axes parallel comprises a first axle supporting said first wheel, plate means for supporting said first axle, a second axle supporting said second wheel, yoke means for supporting said second axle, said yoke means being slidable relative to said plate means such that said axles are parallelly movable relative to each other.

4. Apparatus according to claim 3, wherein said adjusting means further comprises a pressure plate mounted between said plate means, said adjustment member comprising an adjustment screw threadably mounted in said pressure plate and engagable with said yoke means.

5. Apparatus according to claim 3, wherein said plate means comprise a pair of spaced plates having confronting longitudinal channels therein, said first axle being supported in said channels at a first position, said yoke means comprising a bifurcated yoke having a pair of legs slidable in said channels, said second axle being mounted between the legs of said bifurcated yoke.

6. Apparatus according to claim 5, wherein said adjusting means comprises a pressure plate, a transverse slot in each of said plates intersecting said channels, said pressure plate adapted to be received in the slots of said plates, said adjustment member comprising an adjustment screw threadably mounted in said pressure plate and engagable with said bifurcated yoke.

7. Apparatus according to claim 5, including means for affixing said first axle to said spaced plates and means for affixing said second axle to the legs of said bifurcated yoke.

8. Apparatus according to claim 7, wherein said first wheel is rotatably mounted on said first axle and said second wheel is rotatably mounted on said second axle.

9. Apparatus according to claim 5, including a side projection on each leg of said bifurcated yoke, a respective side projection being engagable with and slidable in a respective one of said longitudinal channels.

10. Apparatus according to claim 9, wherein said longitudinal channels are closed at one end thereof and open at the other end thereof, said first axle having ends supported at the closed ends of the channels, said side projections of said bifurcated yoke being slidable into the open ends of the channels.

11. Apparatus according to claim 1, wherein said fist wire shaping wheel has a cylindrical periphery, the peripheral grove of the fist wheel and the cylindrical periphery of the second wheel forming a wire passage at a point of contact of the wheel peripheries.

12. Apparatus according to claim 11, wherein said passage has a trapezoidal cross section for forming a wire with a trapezoidal cross section corresponding to that of said passage.

13. Apparatus according to claim 1, wherein said adjusting means further comprises a pressure plate means for supporting said adjustment member, said adjustment member comprising only one adjustment screw threadably mounted in said pressure plate.

14. A method of forming shaped wires and stranding the wires to form a stranded cable comprising the steps of:

providing a plurality of wire shaping means on a layhead of a stranding apparatus, each wire shaping means comprising a pair of rolls having peripheral surfaces which define a wire shaping passage, each of said rolls having an axle with an axis;

non-adjustably fixing one of said roll axles to the layhead with the axis thereof at a given orientation;

using only one adjustment member, adjustably moving said other roll axis substantially parallelly toward the other roll axis until the peripheral surfaces of the rolls are in contact and the axes of said rolls are maintained in substantially parallel relation.

15. The method of claim 14 including the steps of passing one or more core wires through the layhead, shaping a plurality of wires in said wire shaping means and stranding the shaped wires about the core wire to form a stranded cable.

16. The method of claim 14 including the step of shaping a wire in the wire shaping passage to a trapezoidal cross section.

17. Apparatus for stranding a cable from wires comprising a layhead, a plurality of means mounted on aid layhead for shaping said wires prior to stranding, at least some of said wires being arranged to pass through a respective wire shaping means, each wire shaping means comprising a first wire shaping wheel rotatable about a first axis, a second wire shaping wheel rotatable about a second axis, first and second axles for rotatably supporting said fist and second wheels, a pair of spaced plates having longitudinal axes, said first axle being supported between said plates, yoke means for supporting said second axle, said yoke means being slidable relative to the longitudinal axes of said plates chic that said axles are parallelly movable relative to each other, means for adjusting the spacing between said first and second axles, said adjusting means comprising only one adjustment member, said adjusting means further comprising a pressure plate, a slot in each for said plates disposed transversely to the longitudinal axes of said plates, said pressure plate being removably mounted in said slots, said adjustment member being adjustably mounted in said pressure plate and engagable with said yoke means.

18. Apparatus according to claim 17, wherein said plates having confronting longitudinal channels therein, aid slots transversely intersecting said channels, said first axle being disposed in said channels.

19. Apparatus according to claim 18, wherein said pressure plate has T-shaped cross-section, a portion of said pressure plate being engagable in aid channels to retain said pressure plate in said slots.

20. Apparatus according to claim 18, wherein said slots and said longitudinal channels extend only partly through the thickness of said plates.

* * * * *